US005383430A

United States Patent [19]

Kamiya

[11] Patent Number: 5,383,430

[45] Date of Patent: Jan. 24, 1995

[54] ROTATIONAL SPEED CONTROL APPARATUS FOR INTERNAL COMBUSTION ENGINES

[75] Inventor: Naoyuki Kamiya, Kariya, Japan

[73] Assignee: Nippondenso Co., Ltd., Kariya, Japan

[21] Appl. No.: 98,032

[22] Filed: Jul. 28, 1993

[30] Foreign Application Priority Data

Jul. 30, 1992 [JP] Japan ..... 4-203938

[51] Int. Cl.[6] ..... F02M 3/00

[52] U.S. Cl. ..... 123/339

[58] Field of Search ..... 123/339; 364/431.12

[56] References Cited

U.S. PATENT DOCUMENTS

| | | | |
|---|---|---|---|
| 4,602,601 | 7/1986 | Kamai | 123/339 |
| 4,860,707 | 8/1989 | Ohata | 123/339 |
| 5,010,866 | 4/1991 | Ohata | 123/341 |
| 5,184,588 | 2/1993 | Kato et al. | 123/339 |
| 5,228,421 | 7/1993 | Orzel | 123/339 |
| 5,289,807 | 3/1994 | Yonekawa | 123/325 |

FOREIGN PATENT DOCUMENTS 59-201938 11/1984 Japan .

2-266155 10/1990 Japan .

*Primary Examiner*—David A. Okonsky

*Attorney, Agent, or Firm*—Cushman, Darby & Cushman

[57] ABSTRACT

A rotational speed control apparatus for internal combustion engines is constructed so that, when drive control of an idling speed control valve is performed based on a reference control quantity of the idling speed control valve, a highland learning value or a lowland learning value is stored for the idling speed control and a feedback correction quantity is computed for the idling speed control, in order to control a rotational speed of an internal combustion engine for a vehicle at a desired rotational speed, which is set in accordance with an engine temperature, at the time of an idling operation of the internal combustion engine. It is therefore possible to prevent an excessive drop in the rotational speed or a stall of the internal combustion engine, which occurs after the vehicle has descended a slope to a lowland, due to erroneous learning which is caused when the vehicle descends a slope from a highland to a lowland while travelling from a lowland to a highland and then to a lowland and so on.

8 Claims, 7 Drawing Sheets

ROTATIONAL SPEED CONTROL APPARATUS FOR INTERNAL COMBUSTION ENGINES

BACKGROUND OF THE INVENTION

1. Field of the Invention

The present invention relates to a rotational speed control apparatus for internal combustion engines for controlling an idling rotational speed of an internal combustion engine by driving an idling speed control valve (hereinafter referred to as an ISCV) capable of controlling an opening of a bypass bypassing a throttle valve of the internal combustion engine.

2. Description of Related Art

Conventionally, in this kind of apparatus, a reference control value of an ISCV is computed, an engine rotational speed is detected at the time of the idling operation of the engine, a feedback correction quantity for the reference control value is computed for controlling the engine rotational speed to a desired rotational speed in accordance with an engine temperature, and the ISCV is driven based on the reference control value and the feedback correction quantity.

Learning control using a learning value is performed in the feedback control operation described above. Since a deviation is caused by a fluctuation of the rotational speed when the rotational speed control is made only by the use of a reference control value, feedback control is made in order to make an engine rotational speed coincide with a desired rotational speed Ne by further correcting the deviation described above. In this case, the feedback control value is used to update a learning value. Namely, when a given number of feedback control values have been obtained, a feedback control value obtained at an appropriate timing is adopted as a learning value and the other obtained feedback control values are nullified.

When the feedback correction quantities computed in the above-described way are stabilized within a predetermined range, a feedback correction quantity in the predetermined range is successively stored and used to update an ISC learning value for use in computing a next feedback correction quantity so that the engine rotational speed may be made to coincide with the desired engine rotational speed quickly in the course of the feedback control operation.

On the other hand, it is necessary to correct the reference control value itself when travelling on a highland because the atmospheric pressure itself is lowered. Therefore, the reference control value $ISC_H$ has been computed by the following equation.

$$ISC_H = ISC_{BASE} \times C_{HAC} \quad (1)$$

In the above equation, $ISC_{BASE}$ represents a basic air quantity which is set in accordance with an engine temperature, and $C_{HAC}$ represents an ISC correction quantity, which is shown as a multiplication coefficient for the basic air quantity $ISC_{BASE}$. This ISC correction quantity $C_{HAC}$ is set beforehand as a value corresponding to an atmospheric pressure value obtained based on an experimental result or the like, as shown in FIG. 6. The ISC correction quantity $C_{HAC}$ is set as "1.0" at a reference altitude (lowland), and the correction quantity is made larger (namely, the multification coefficient becomes larger) as the atmospheric pressure is lowered.

Furthermore, as a system for obtaining the atmospheric pressure value while the engine-driven vehicle is travelling, there is known a system of obtaining an atmospheric pressure value through presumptive computation of the altitude by using the ratio of an intake air quantity at the reference altitude to the intake air mass flow rate obtained by mass flow rate measuring means (for example, JP-A-2-266155), and a system of performing presumptive learning of a signal of a pressure sensor as the atmospheric pressure value, when the throttle opening has a predetermined opening value or more (for example, JP-A-59-201938).

In the case of presumptively learning the atmospheric pressure value by using techniques other than that which uses the atmospheric pressure sensor, it is often the case that the condition of performing presumptive learning of the atmospheric pressure value is satisfied when the throttle opening has a predetermined value or more. According to a result of investigation made by the Applicant, in the case of the above-referred JP-A-2-266155, the relationship between the throttle opening and the intake air quantity passing through the throttle valve is not linear, and there exists a region where a variation of the intake air quantity is reduced when the throttle opening has a predetermined value or more, as shown in FIG. 7, and very stable learning can be made when presumptive learning of the atmospheric pressure is performed in this region. In the case of a practical engine-driven vehicle, the condition of effecting presumptive learning is limited to the above-mentioned region. Further, the above-referred JP-A-59201938 relates to a system of taking in a value, just when the throttle is fully opened, as an atmospheric pressure value. Therefore, the state wherein the throttle opening is fully open is a prerequisite condition for performing the atmospheric pressure presumptive learning.

In a system in which the atmospheric pressure presumptive learning is performed under the condition of a wide-open throttle valve near its fully open state, as is the case with the conventional examples described above, the throttle wide-open condition occurs frequently when ascending a slope of a mountain road. Therefore, the atmospheric pressure learning value is updated as the altitude increases while ascending a slope. Further, since the ISC atmospheric pressure correction is also made in response to the updating of the atmospheric pressure learning value, the idling rotational speed control can be made very smoothly.

However, when considering the case of descending a slope, there would be no chance of performing the atmospheric pressure learning at all or the chance of doing so would become rare, when a driver continues to drive the engine in an idle-on state or in a very small throttle opening state, for example. In this case, there occurs a state that the last learning value of the atmospheric pressure value obtained on a highland is stored, as it is, even after the vehicle has descended to a lowland.

As a result, the ISC correction quantity $C_{HAC}$ has an erroneous value. Namely, according to the ISC correction quantity $C_{HAC}$ shown in FIG. 6, the air density is lowered as the altitude increases, as described above. Therefore, correction is made in a direction of increasing the opening of the ISCV in order to maintain the idling speed constant. Since the atmospheric pressure learning is performed correctly at time of ascending a slope, the opening correction for the ISC is also made correctly, thus causing no problem. However, if the atmospheric pressure value remains as it was obtained on a highland even after the vehicle has descended to a lowland in a slope descending mode, the correction quantity of the ISC continues to have a value which has been produced in the throttle valve opening direction as described above.

Here, the operation of the conventional electronic control device poses a problem. When the reference control value $ISC_H$ is increased, the idling rotational speed tends to increase on a lowland. However, as described above, the feedback control of the ISC and the feedback correction quantity learning function act to bring the idling rotational speed near to the desired rotational speed, and, as a result, control is made to reduce the final ISC output at this time.

At this time, an increase of the reference control value $ISC_H$ and a correction of a decrease by the ISC feedback control are performed absolutely independently from each other. Accordingly, when an erroneous atmospheric pressure learning value is retained and used on a lowland, there occurs a state such that an increasing correction amount of the reference control value $ISC_H$ due to a variation of the atmospheric pressure is decreased by the ISC feedback correction quantity. Since this decrease quantity by the feedback correction quantity is gradually replaced by the ISC learning value, the atmospheric pressure learning condition is not established immediately after descending to a lowland, but a state of a highland correction caused by erroneous learning continues until the decreased quantity learning of the ISC is completed.

Thereafter, when the atmospheric pressure learning is performed, the atmospheric pressure value becomes equal to the reference altitude (lowland) value, and a highland increase amount to be added to the ISC basic flow rate also becomes zero. Namely, the control state of the ISC presents a state of a basic flow rate devoid of highland correction plus a learning value (or an ISC feedback decrease value) subjected to a reduction by a quantity corresponding to the highland increase amount described above. As a result, when this atmospheric pressure learning value is updated, the air quantity given by the final ISC output becomes insufficient, thus resulting in a reduction of the idling speed or further in an engine stall.

SUMMARY OF THE INVENTION

Thus, it is an object of the present invention to solve the problem described above and to provide a rotational speed control apparatus for internal combustion engines capable of preventing a decrease of the idling rotational speed or an engine stall from occurring when the atmospheric learning value has returned to a normal value, by switching a highland learning value in a decreased state to a normal lowland learning value stored before ascending a slope, at the time when the ISC highland learning value increasing correction has ceased suddenly.

A rotational speed control apparatus for internal combustion engines proposed by the present invention in order to attain the above-mentioned object has a structure such as described hereunder.

Namely, there is provided a rotational speed control apparatus for internal combustion engines including: atmospheric pressure presumptive computation means for performing presumptive computation of the atmospheric pressure indirectly based on a predetermined control value and a detection value which vary with a change of the driving state of an internal combustion engine; an idling speed control valve provided in a bypass bypassing a throttle valve of the internal combustion engine and capable of controlling an opening degree of the bypass; a reference control quantity computing means for computing a reference control quantity of the idling speed control valve in accordance with the atmospheric pressure obtained by the presumptive computation; a feedback correction quantity computing means for detecting the rotational speed of the internal combustion engine at the time of an idling operation of the internal combustion engine and computing a feedback correction quantity for the reference control quantity in order to control the rotational speed at a desired rotational speed which is set in accordance with an engine temperature; ISC learning value storage means for storing a correction quantity at the time when the feedback correction quantity computed by the feedback correction quantity computing means is stabilized within a predetermined range while updating it successively as an ISC learning value; and ISCV drive control means for driving the idling speed control valve based on a reference control quantity computed by the reference control quantity computing means, a feedback correction quantity computed by the feedback correction quantity computing means and an ISC learning value stored in the ISC learning value storage means, which rotational speed control apparatus comprises: high/low pressure area determining means for discriminating between a lowland corresponding area and a highland corresponding area depending on whether or not the presumed atmospheric pressure is equal to or higher than a predetermined highland determining atmospheric pressure, wherein the ISC learning value storage means is composed of a lowland learning value storage section for storing the ISC learning value for the lowland corresponding area as a lowland ISC learning value and a highland learning value storage section for storing the ISC learning value for the highland corresponding area as a highland ISC learning value, based on the result of the discrimination by the high/low pressure area determining means; and further comprising ISC learning value selection means for selecting the lowland ISC learning value when the result of discrimination by the high/low pressure area determining means indicates the lowland corresponding area, while selecting the highland ISC learning value when the result of discrimination by the high/low pressure area determining means indicates the highland corresponding area, respectively, as an ISC learning value for use in a next feedback correction quantity computation by the feedback correction quantity computing means.

According to the rotational speed control apparatus for internal combustion engines of the present invention having the structure described above, the high/low pressure area determining means discriminate between a lowland corresponding area and a highland corresponding area depending on whether or not the presumed atmospheric pressure is equal to or higher than a predetermined highland determining atmospheric pressure. Further, the ISC learning value storage means stores the ISC learning value for the lowland corresponding area as a lowland ISC learning value in a lowland learning value storage section and stores the ISC learning value for the highland corresponding area as a highland ISC learning value in a highland learning value storage section, based on the result of the discrimination by the high/low pressure area determining means.

Then, the ISCV drive control means drives the ISCV based on a reference control quantity computed by the reference control quantity computing means and a feedback correction quantity computed by the feedback correction quantity computing means by using the ISC learning value.

The ISC learning value used when the feedback correction quantity is computed is a value which is obtained by the ISC learning value selection means which operates to select a lowland ISC learning value when the result of the discrimination by the high/low pressure area determining means indicates a lowland corresponding area, while, to select a highland ISC learning value when the result of the discrimination by the high/low pressure area determining means indicates a highland corresponding area.

When a vehicle ascends an upward slope of a mountain road and then successively descends a downward slope, for example, a lowland ISC learning value is updated before ascending the slope, and a highland ISC learning value is updated during ascending the slope and while travelling near the hilltop. Since atmospheric pressure learning is performed correctly until the hilltop is reached and accordingly an ISC highland correction is also performed correctly, learning values contain no large deviation. However, the atmospheric pressure learning is no longer performed when the descent of the slope is started as described above. Therefore, because of the decrease in altitude, the air density becomes thicker, and a state is reached where the ISC highland correction quantity should be reduced or nullified, if ISC correction is continued using the atmospheric pressure learning value, there occurs a case where the determination of the ISC correction cannot be made correctly.

In such a case, this learning value is obtained originally through erroneous learning, so that, if this learning value is maintained, the idling speed would drop when the atmospheric pressure value is updated to have a normal value. However, in the present invention, erroneous learning is caused to continue intentionally using the highland ISC learning value ($QLRN_H$), and the ISC learning value (QLRN) is switched to the lowland ISC learning value ($QLRN_L$), which has been stored previously before ascending the slope, as soon as the atmospheric pressure value returns to a normal value so that the lowland ISC learning value ($QLRN_L$) may be used to obtain a final ISC output value. Besides, the lowland ISC learning value ($QLRN_L$) is used in place of the highland ISC learning value ($QLRN_H$) used when performing erroneous learning.

Thus, it is possible to return the atmospheric pressure learning value to a normal value maintaining the total ISC quantity unchanged, by switching a highland learning value in a decreased state to a normal lowland learning value stored before ascending a slope, at the time when the ISC highland increasing correction is stopped suddenly.

DESCRIPTION OF THE PREFERRED EMBODIMENTS

An embodiment of the present invention will be described hereinafter with reference to the accompanying drawings.

Figure 1:
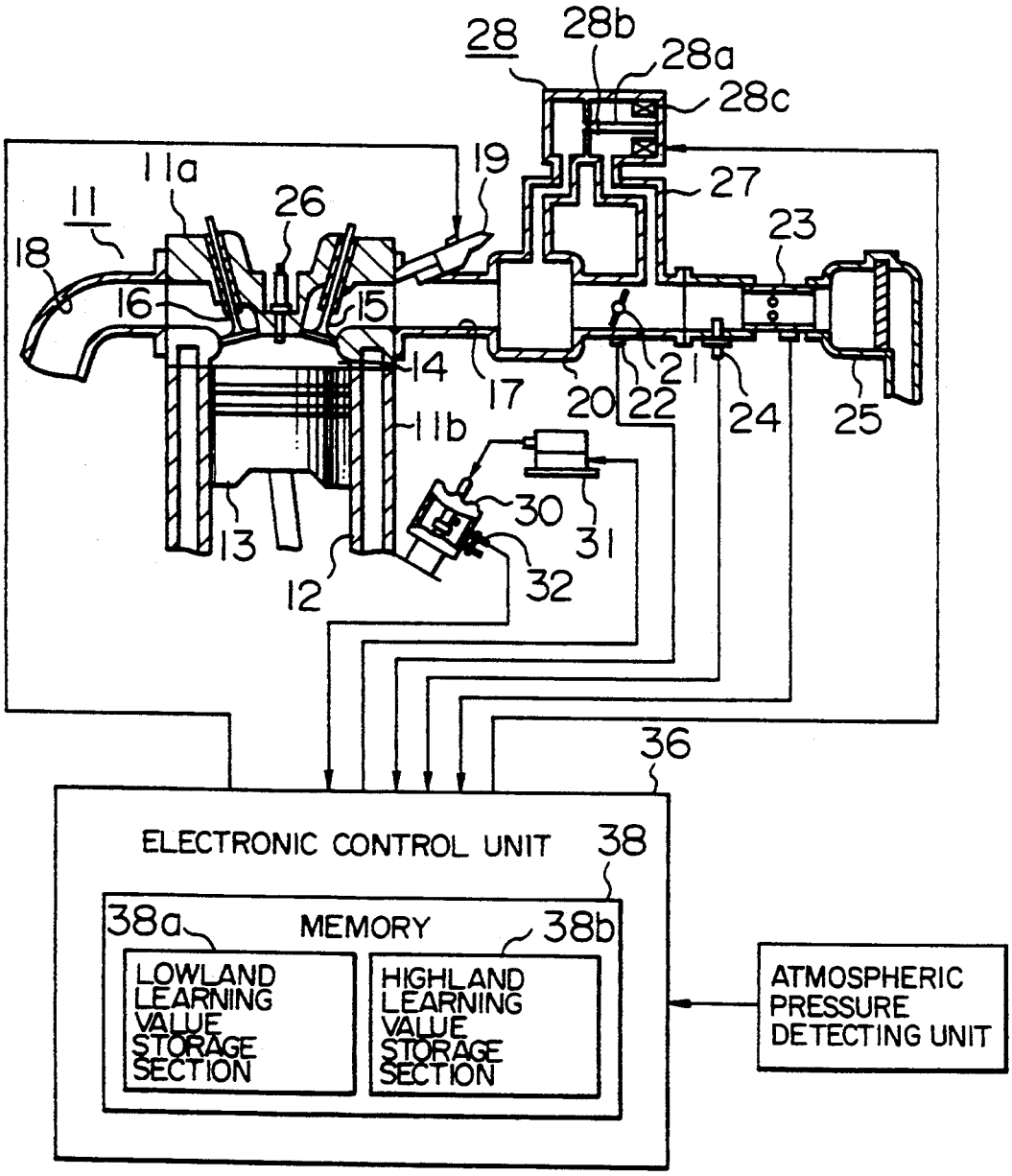
FIG. 1 is a schematic block diagram showing an embodiment of an internal combustion engine for vehicles and peripheral equipment thereof to which the present invention has been applied.

FIG. 1 is a schematic block diagram showing a multicylinder internal combustion engine 11 (hereinafter referred to simply as an engine) for vehicles and peripheral equipment thereof to which the present invention has been applied. The engine 11 has a piston 13 disposed in a cylinder 12, and a combustion chamber 14 enclosed with a cylinder head **11*a* and a cylinder block 11*b* is formed above the piston 13. An ignition plug 26 is disposed in the combustion chamber 14. Further, the combustion chamber 14 communicates with an intake air passage 17 and an exhaust passage 18 through an intake valve 15 and an exhaust valve 16**, respectively.

A fuel injection valve 19 for each cylinder is provided in the intake air passage 17, and a surge tank 20 for decreasing pulsation of intake air at the time of suction thereof is provided in the intake air passage 17 upstream of the fuel injection valve 19. Upstream of the surge tank 20 a throttle valve 21 is provided which is opened and closed interlinked with the operation of an accelerator pedal (not illustrated), and an intake air quantity into the intake air passage 17 is adjusted by the opening and closing operation of the throttle valve 21.

A throttle sensor 22 for detecting the opening degree of the throttle valve 21 is provided near the throttle valve 21. A thermal type air mass flowmeter 23 is provided upstream of the throttle valve 21, and a measured intake air mass flow rate Gm of the intake air introduced into the intake air passage 17 is detected by the thermal type air mass flowmeter 23. A mean value within a given period of time is adopted as the value of the measured intake air mass flow rate Gm.

An intake air temperature sensor 24 for detecting an intake air temperature is provided between the thermal type air mass flowmeter 23 and the throttle valve 21. Further, an air cleaner 25 is provided upstream of the thermal type air mass flowmeter 23.

Thus, air taken in through the air cleaner 25 is sent to the downstream side of the intake air passage 17 via the thermal type air mass flowmeter 23, the throttle valve 21 and the surge tank 20, and is mixed with fuel injected by the fuel injection valve 19 at the downstream side of the intake air passage 17 to thereby form a mixture gas. This mixture gas is introduced into the combustion chamber 14 through the intake valve 15. Then, the engine 11 causes the mixture gas to explode in the combustion chamber 14 by the operation of the ignition plug 26 so as to generate a driving force, and an exhaust gas thus produced is discharged into the exhaust passage 18 through the exhaust valve 16.

Further, the intake air passage 17 is provided with a bypass air passage 27 as an auxiliary air passage which bypasses the throttle valve 21 and provides subsidiary communication between the upstream side of the throttle valve 21 and the surge tank 20. An idling speed control valve ISCV 28 operating as an actuator for adjusting an auxiliary air supply quantity is provided midway of this bypass air passage 27. In the ISCV 28, a valve body **28*a* is always urged to abut a valve seat portion 28*b* by a spring (not shown), but the valve body 28*a* is made to depart from the valve seat portion 28*b* by energizing a coil 28*c***.

Thus, it is arranged so that the bypass air passage 27 is opened by the energization of the coil **28*c* of the ISCV 28, and the bypass air passage 27 is closed by the de-energization of the coil 28*c*. The opening of this ISCV 28** is adjusted by the duty ratio control based on pulse width modulation.

A distributor 30 provided to distribute a high voltage output from an ignitor 31 among respective ignition plugs 26 synchronously with a crank angle of the engine 11, and the ignition timing of each of the ignition plugs 26 is determined by the output timing of the high voltage from the ignitor 31.

Further, a rotational speed sensor 32 functioning as operating state detecting means, which detects a crank angle from the rotation of a rotor of the distributor 30 and outputs a pulse signal, is provided in the distributor 30.

An electronic control unit 36 (hereinafter referred to as an ECU) is composed of atmospheric pressure presumptive computation means, reference control quantity computing means, feedback correction quantity computing means, ISC learning value storage means, ISCV drive control means, high/low pressure area determining means and ISC learning value selection means. There are connected to the electronic control unit 36 the throttle sensor 22, the thermal type air mass flowmeter 23, the intake air temperature sensor 24 and the rotational speed sensor 32 so that signals from the respective sensors are inputted thereto. Further, the electronic control unit 36 has connection lines leading to the injection valve 19, ISCV 28 and ignitor 31 and outputs a drive signal supplied to each of the driving sections thereof.

Further, in a memory 38 contained in the ECU 36 and operating as the ISC learning value storage means, a lowland learning value storage section **38*a* for storing a lowland ISC learning value $QLRN_L$ described later and a highland learning value storage section 38*b*** for storing a highland ISC learning value $QLRN_H$ are included.

Next, controlling operations performed in the ECU 36 will be described, respectively. First, presumptive learning processing of an atmospheric pressure will be described with reference to FIG. 8. In the present embodiment, a system is adopted in which presumptive computation of an altitude is performed from a ratio of an intake air quantity to an intake air mass flow rate at a reference altitude when the throttle opening degree is equal to or larger than a predetermined value (step 420) and the atmospheric pressure corresponding thereto is presumed, as stated also in JP-A-2-266155 described above.

Describing the foregoing in more detail, an intake air mass flow rate Gc is retrieved from an engine rotational speed Ne and a throttle opening degree detected actually (step 430) using a three-dimensional map (not illustrated) in which the intake air quantity Gc at a reference altitude is allocated with respect to an engine rotational speed Ne (step 400) and a throttle opening degree Tvo (step 410). Then, presumptive computation of an altitude is performed (step 450) from a ratio of the retrieved intake air mass flow rate Gc to the measured intake air mass flow rate Gm detected by the thermal type air mass flowmeter 23 (step 440), thereby presuming the atmospheric pressure corresponding to the altitude thus computed (step 460). Here, the altitude presumptive computation (step 450) may be omitted.

Figure 8:
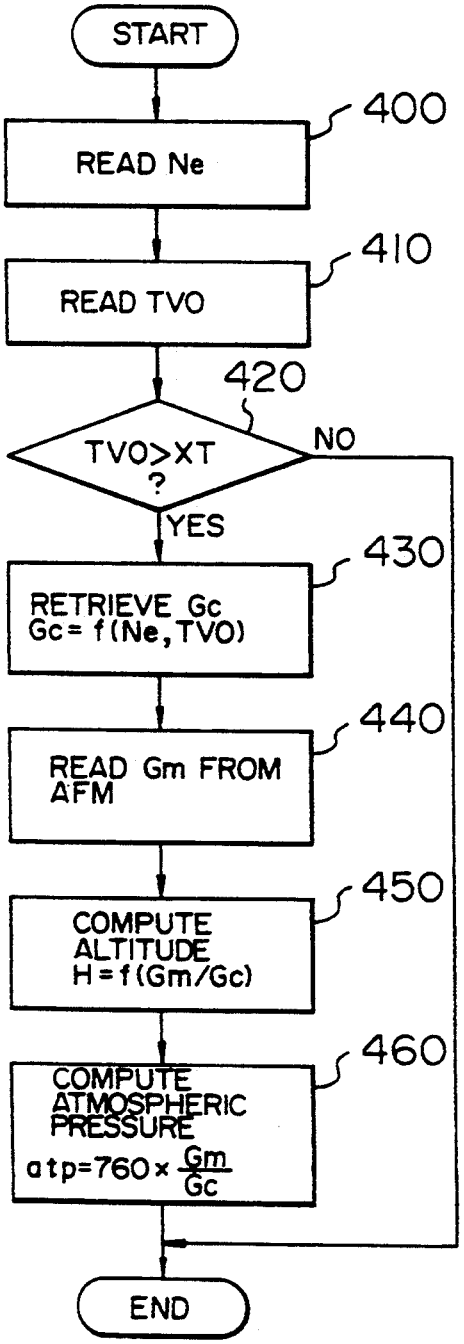
FIG. 8 PRIOR ART
FIG. 8 is a flow chart showing an atmospheric pressure presumptive learning system.

The definition of each of the reference symbols shown in FIG. 8 is enumerated as follows.

Pm: Pressure sensor value;
Ne: Rotational speed;
Tvo: Throttle opening degree;
xT: Predetermined throttle opening degree;
Gc: Retrieved value of intake air mass flow rate;
AFM: Thermal type mass flowmeter;
Gm: Measured value of intake air mass flow rate;
H: Altitude;
ATP: Atmospheric pressure; and
WOT: Predetermined throttle opening degree (near full throttle opening).

Figure 9:
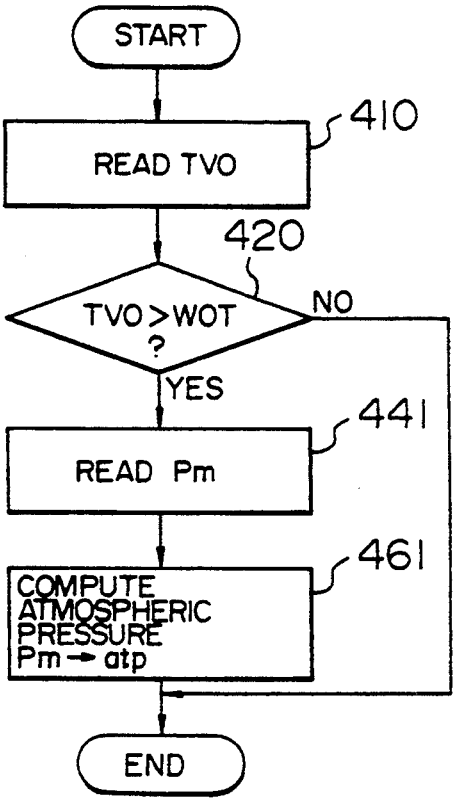
FIG. 9 PRIOR ART
FIG. 9 is a flow chart showing another atmospheric pressure presumptive learning system.

Further, a system of performing presumptive learning of the atmospheric pressure based on the intake air mass flow rate Gc and the measured intake air mass flow rate Gm is adopted in the present embodiment. However, the system is not limited thereto, so far as a system is concerned which "presumes" the atmospheric pressure without directly detecting the same. For example, it may be possible to adopt such a system in which a pressure sensor is provided in the intake air passage 17, and an output signal of the pressure sensor is read out when the throttle opening degree is equal to or larger than a predetermined value (step 441), as shown in FIG. 9, thereby presumptively learning the value as the atmospheric pressure value (step 461). FIG. 9 shows a system of presuming atmospheric pressure with an example of using an intake airpipe pressure sensor.

Figure 10:
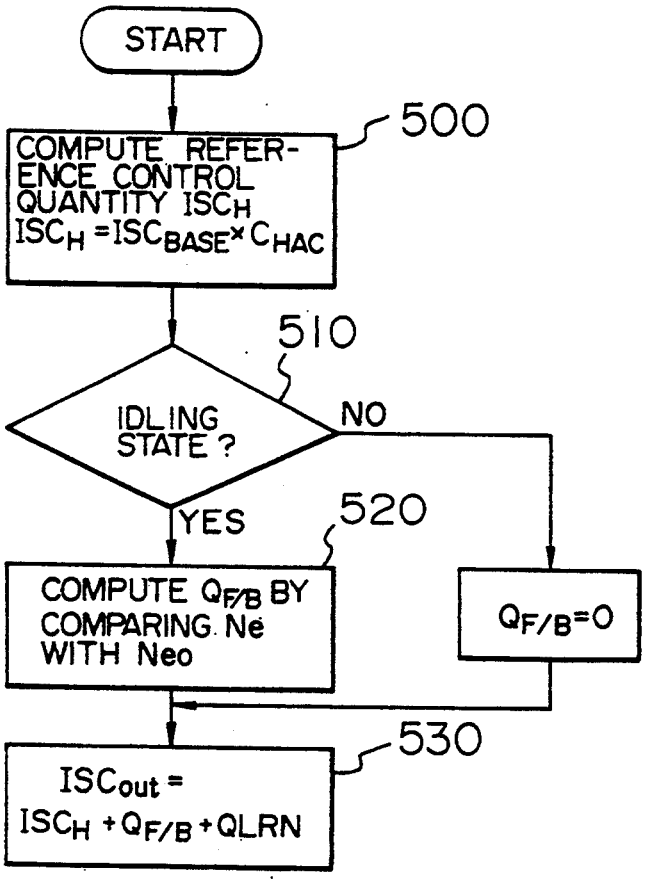
FIG. 10 PRIOR ART
FIG. 10 is a flow chart showing an ISC control system at the time of idling operation of the internal combustion engine.

The ISC control system performed at the idling time is of the general nature such as explained in the BACKGROUND OF THE INVENTION described previously. Hence, a detailed description thereof is omitted, and only a brief condensed explanation will be made here with reference to the illustration of FIG. 10.

Figure 6:
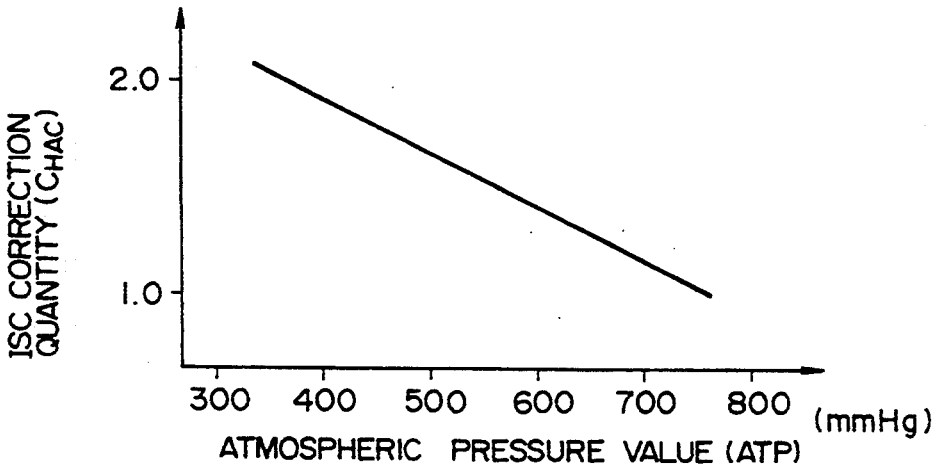
FIG. 6 PRIOR ART
FIG. 6 is a graph showing an ISC correction quantity corresponding to atmospheric pressure.
Figure 7:
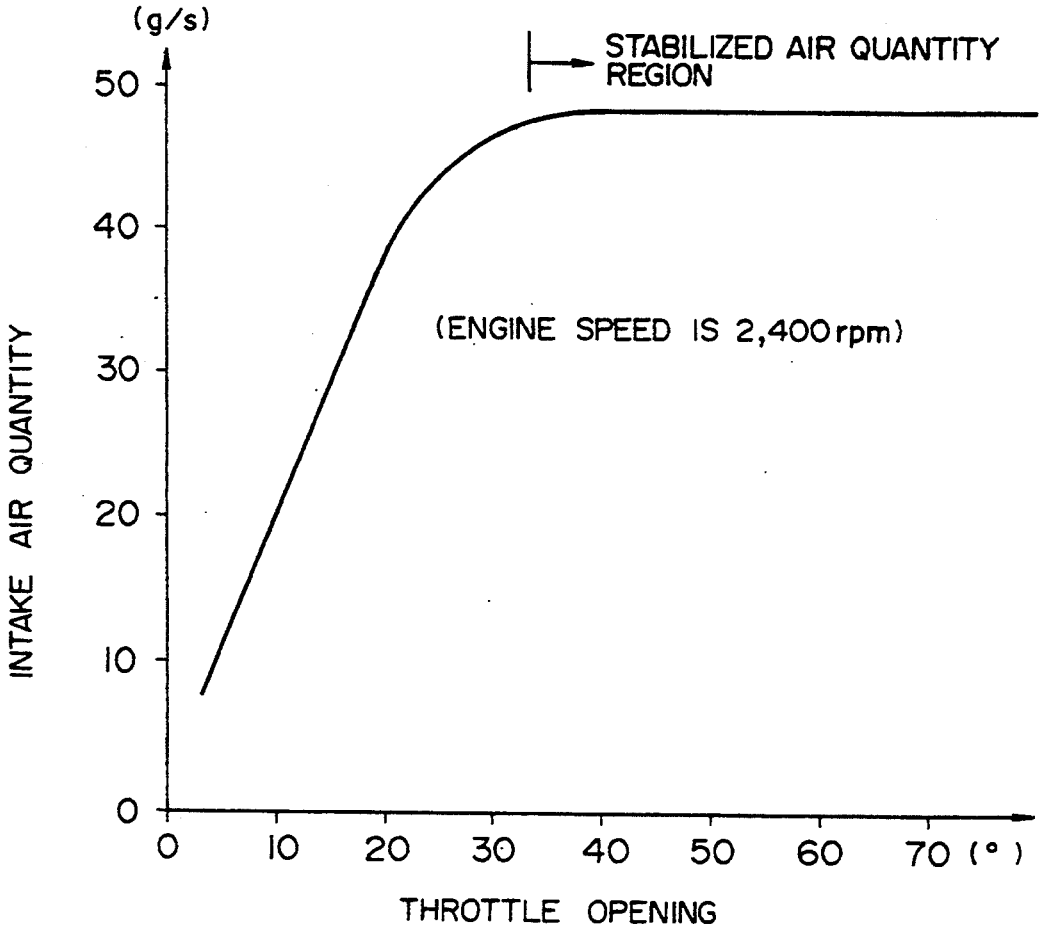
FIG. 7 PRIOR ART
FIG. 7 is a graph showing the relationship between a throttle opening and a throttle passing air quantity.

Namely, this system is a well-known control system in which a reference control quantity $ISC_H$ of the ISCV is computed based on a basic air quantity $ISC_{BASE}$ and an ISC correction quantity $C_{HAC}$ shown in FIG. 6 ($ISC_H = ISC_{BASE} \times C_{HAC}$ in step 500), and a feedback correction quantity $Q_{F/B}$ for a reference control quantity $ISC_H$ is computed so that an engine rotational speed Ne detected by the rotational speed sensor 32 may be equal to a predetermined desired idling rotational speed Neo (step 520) when the throttle sensor 22 has detected an idling state where the throttle valve is totally closed (step 510), and then, an ISC output $ISC_{OUT}$ for controlling the opening of the ISCV 28 is obtained based on the reference control quantity $ISC_H$, the feedback correction quantity $Q_{F/B}$ and the ISC learning value QLRN (step 530).

Figure 2:
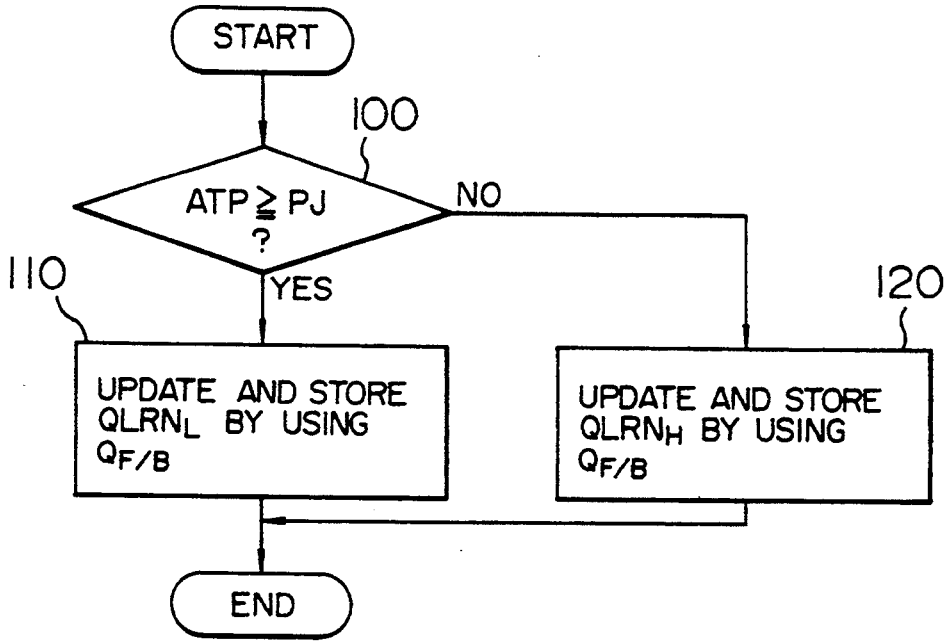
FIG. 2 is a flow chart showing ISC learning value storage processing.

Further, a correction quantity $Q_{F/B}$ at the time when the computed feedback correction quantity is stabilized within a predetermined range is used to successively update an ISC learning value QLRN and the updated ISC learning value is stored to be used in subsequent feedback control. In the embodiment of the present invention, however, the updated ISC learning value is stored while sorting it as described hereunder. This ISC learning value storage processing will be described with reference to FIG. 2.

First, it is determined in a step 100 whether or not the read-out atmospheric pressure ATP is equal to or larger than a predetermined highland determination atmospheric pressure PJ (600 mmHg for instance). Then, if the read-out atmospheric pressure ATP is equal to or higher than the highland determination atmospheric pressure PJ, it is decided to indicate a pressure area corresponding to lowland, and, in a step 110, a lowland ISC learning value $QLRN_L$ is updated by the feedback correction quantity $Q_{F/B}$ in this case and stored in the lowland learning value storage section 38*a* in the memory 38. On the other hand, when the atmospheric pressure ATP is lower than the highland determination atmospheric pressure PJ, it is decided to indicate a pressure area corresponding to highland, and, in a step 120, a highland ISC learning value $QLRN_H$ is updated by the feedback correction quantity $Q_{F/B}$ in this case and stored in the highland learning value storage section 38*b*.

Figure 3:
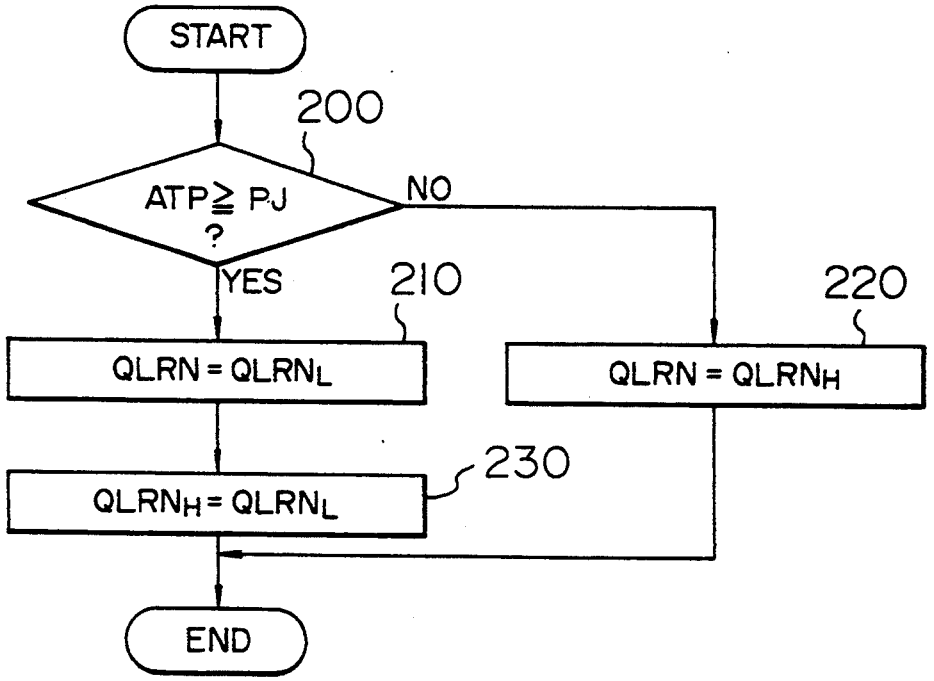
FIG. 3 is a flow chart showing ISC learning value selection processing.

Next, ISC learning value selection processing, which is a main processing of the present invention executed in the ECU 36 to control the rotational speed, will be described with reference to FIG. 3. The ISC learning value QLRN is related to the final ISC output $ISC_{OUT}$ as shown by the following equation.

$$ISC_{OUT}=ISC_H+QLRN+Q_{F/B}+\ldots \text{ where } QLRN=QLRN_L \text{ or } QLRN_H \quad (2)$$

The present ISC learning value selection process is a processing for selecting this ISC learning value QLRN. Firstly, a decision is made as to whether or not the atmospheric pressure ATP which has been read in a step 200 is equal to or higher than the predetermined highland determination atmospheric pressure PJ (=600 mmHg). Then, if the read-out atmospheric pressure ATP is equal to or higher than the highland determination atmospheric pressure PJ, it is decided to indicate a pressure area corresponding to lowland at present, and, in a step 210, the lowland ISC learning value $QLRN_n$ stored in the lowland learning value storage section 38*a* is adopted as the ISC learning value QLRN in the above equation (2).

On the other hand, if the atmospheric pressure ATP is lower than the highland determination atmospheric pressure PJ, it is decided to indicate a pressure area corresponding to highland at present, and, in a step 220, the highland ISC learning value $QLRN_H$ stored in the highland learning value storage section 38*b* is adopted as the ISC learning value QLRN in the above equation (2).

Accordingly, the ISC learning value QLRN is set to the highland ISC learning value $QLRN_H$ from the time when the vehicle has entered a pressure area corresponding to highland where the atmospheric pressure value ATP is lower than 600 mmHg, for instance, while, the lowland ISC learning value $QLRN_L$ is maintained at a value before ascending the slope.

By doing so, a lowland learning value is updated before ascending a slope, and a highland learning value is updated during ascending a slope or near a hilltop. Thus, atmospheric pressure learning is made correctly up to the hilltop, and accordingly ISC highland correction is also made correctly. As a result, the learning value is not troubled by any prominent deviation.

However, when a driver continues driving in the idling-on state or in a very small throttle opening state while descending a slope, for example, the atmospheric pressure presumptive learning described above is no longer performed. Then, if the ISC correction is continued based on an atmospheric pressure presumptive learning value even in a state where the altitude is lowered, the air density becomes thicker and the ISC correction quantity $C_{HAC}$ should be reduced, there occurs a case that ISC correction can not be determined properly.

In such a case, this learning value is a value resulting from erroneous learning, and therefore, if this state is maintained as it is, a rotation drop is caused when the atmospheric pressure value is updated to be a normal value. In the present embodiment, however, erroneous learning is caused to continue intentionally using the highland ISC learning value $QLRN_H$, and the ISC learning value QLRN is switched to the lowland ISC learning value $QLRN_L$, which has been stored previously before ascending the slope, as soon as the atmospheric pressure value returns to a normal value so that the lowland ISC learning value $QLRN_L$ may be used to obtain a final ISC output value $ISC_{OUT}$. Further, at the same time, the highland ISC learning value $QLRN_H$ is also replaced by a lowland ISC learning value $QLRN_L$ (step 230). By switching the ISC learning value to a normal lowland ISC learning value which has been stored before ascending the slope as described above, it is possible to prevent a drop in the ISC output $ISC_{OUT}$ from occurring when the atmospheric pressure learning value is returned to a normal value, thereby preventing a drop in the rotational speed or an engine stall from occurring.

Figure 4:
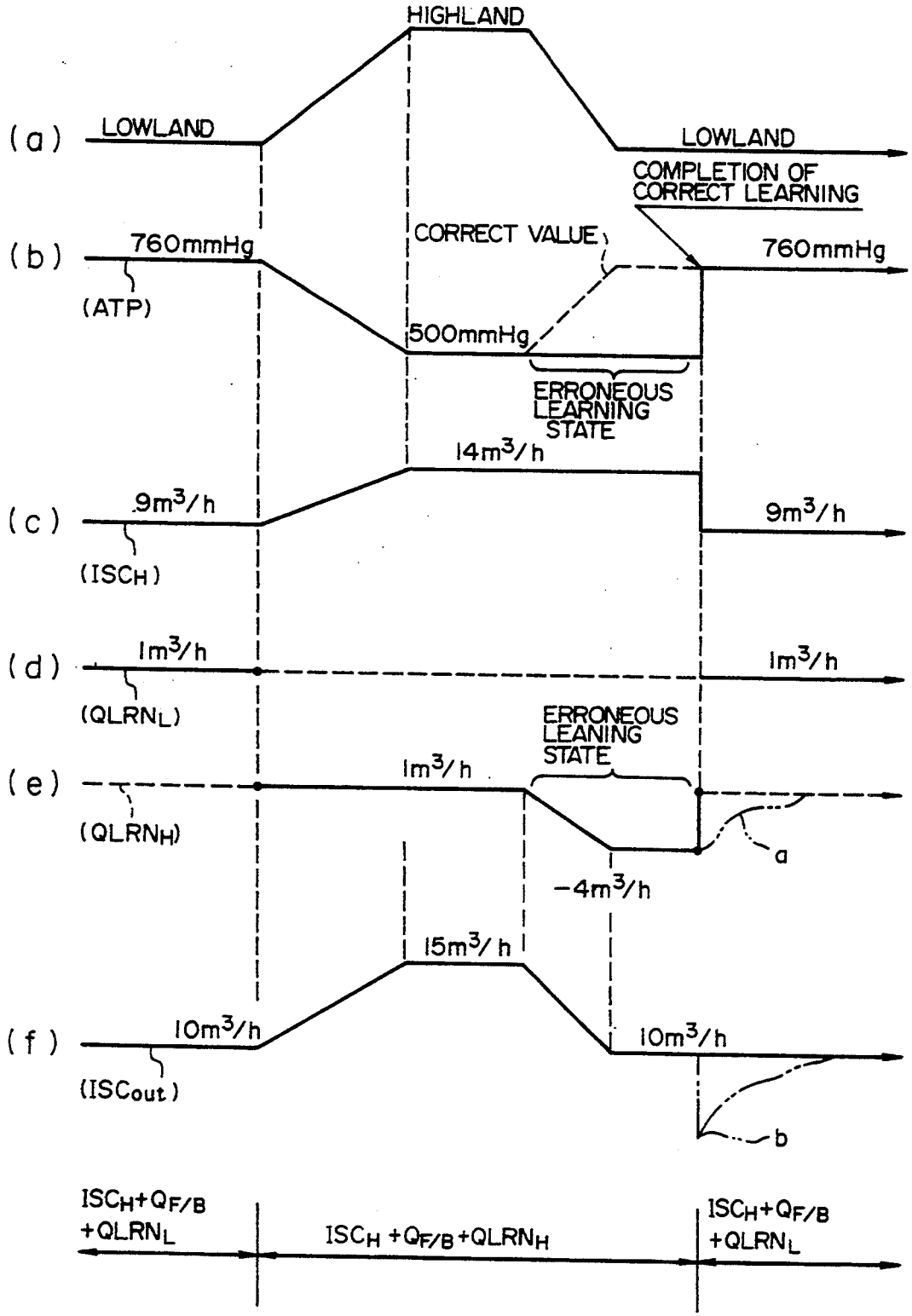
FIG. 4 is a time chart showing the result of control according to an embodiment of the present invention.

The results of the above-described control are shown in the time chart of FIG. 4. As shown at (b) in the time chart of FIG. 4, a correct value shown by a dotted line is obtainable if the atmospheric pressure presumptive learning is performed normally. However, a period of an erroneous learning state of the atmospheric pressure value ATP takes place, since the atmospheric pressure presumptive learning is not performed normally. Then, as a result of the above erroneous learning, erroneous learning is also performed in obtaining the highland ISC learning value $QLRN_H$ as shown at (e) in the time chart of FIG. 4 in correspondence to the erroneous learning period of the atmospheric pressure value ATP.

If one and the same ISC learning value is used as usual, the ISC learning value returns gradually to a normal value, as shown by a two-dot chain line indicated by a symbol a at (e) in the time chart, from the time point when the atmospheric pressure presumptive learning value is updated. Therefore, as shown by a two-dot chain line indicated by a symbol b at (f) in the time chart, the final ISC output $ISC_{OUT}$ drops once at the time point when the atmospheric pressure presumptive learning value is updated, thus resulting in a drop in the engine rotation or in an engine stall.

As compared therewith, according to the present invention, the ISC learning value QLRN is switched to the lowland ISC learning value $QLRN_L$ having a value stored previously before ascending a slope at the same time as the atmospheric pressure value ATP returns to a normal value, as described before, so that the lowland ISC learning value $QLRN_L$ may be used to obtain a final ISC output value $ISC_{OUT}$. As a result, the ISC output $ISC_{OUT}$ does not drop at the time of switching, but it is maintained at 10 $m^3/h$ as Shown in FIG. 4, thus making it possible to prevent a drop in the engine rotation or an engine stall from occurring.

Besides, in the present embodiment, a highland ISC learning value $QLRN_H$ resulted from erroneous learning is replaced by a lowland ISC learning value $QLRN_L$ in a step 230 at the same time as the atmospheric pressure presumptive learning value returns to a normal value. By doing so, the flow rate does not become insufficient before or after the lowland ISC learning value $QLRN_L$ is switched to the highland ISC learning value $QLRN_N$ at the time of ascending a slope a next time, thus making it possible to update a learning value smoothly.

Next, when a vehicle descends a slope from a state that atmospheric pressure value learning has been performed while ascending a slope and the ISC highland correction has been made in accordance therewith, as described above, other problems are posed sometimes. These other problems will be described hereunder.

Conventionally, the establishment of what is called idling conditions, in which the throttle opening is equal to or smaller than a predetermined value and the engine rotational speed Ne is equal to or lower than a predetermined value, is cited as executive conditions for performing feedback control of the ISC, the learning control or the like. However, in the case of descending a slope to a lowland while retaining the atmospheric pressure value ATP obtained by erroneous learning, there may be a case where the ISC highland correction made to increase an air supply quantity does not satisfy an executive condition. That is, even after the engine operation is returned from a vehicle driving state to an idling state (with the throttle valve totally closed), such a state occurs that the rotational speed does not become equal to or lower than a certain predetermined value which is one of the executive conditions. As a result, there occurs a state that ISC feedback control described above and furthermore learning control can not be made, which state is called "an ISC open state". Once this ISC open state occurs, control itself becomes inexecutable.

Further, a conventional technique is known such that, when an ISC learning value itself is obtained by erroneous learning to increase an air supply quantity and the rotational speed can not be decreased, thereby showing the ISC open state, the ISC learning value is decreased, as disclosed by JP-A-3-50357. While, in the problem raised this time, erroneous learning is not made in the ISC, but a final ISC output is increased for the other reason, thereby presenting the ISC open state. The reason therefor is an excessive increase in the air supply quantity caused by the ISC highland correction due to erroneous atmospheric pressure learning.

Figure 5:
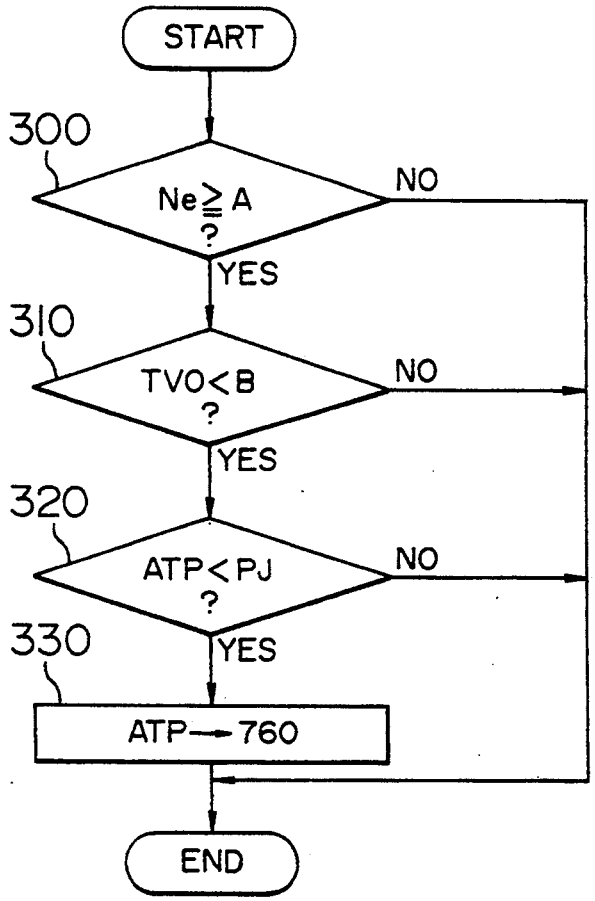
FIG. 5 is a flow chart showing erroneous learning determination processing of atmospheric pressure.

Accordingly, in order to solve the above-described problem, atmospheric pressure erroneous learning determination processing is performed in addition to the above-described selection processing of the ISC learning value and so on. Namely, as shown in the flow chart of FIG. 5, under the conditions where the rotational speed Ne is equal to or higher than a predetermined value A (1,200 rpm, for example) (step 300=YES), the throttle opening Tvo is smaller than a predetermined value B (10 degrees, for example) (step 310=YES), and the atmospheric pressure learning value ATP is smaller than the highland determining atmospheric pressure (600 mmHg, for example) (step 320=YES), then the atmospheric pressure learning value ATP is reduced toward a value corresponding to lowland (760 mmHg).

In this way, by determining that the atmospheric pressure learning value ATP has been obtained by erroneous learning and by shifting the atmospheric pressure value ATP toward a value corresponding to lowland without decreasing the ISC learning value, the ISC highland correction quantity is decreased in response to the shift of the atmospheric pressure value ATP. Thus, the rotational speed Ne is lowered accordingly, and the ISC feedback control enabling condition is satisfied.

In addition, the idea of preventing the ISC open state from being caused by erroneous learning of the atmospheric pressure value can be utilized not only in the system of presuming the atmospheric pressure value, but also in a system having an atmospheric pressure sensor and detecting the atmospheric pressure directly, for example. For example, if the atmospheric pressure erroneous learning determination processing described above is performed as a countermeasure for a failure of the atmospheric pressure sensor, a condition that the ISC feedback control is applicable is satisfied in the same way.

The present invention is not limited to the above-described embodiments, but may be practised in various modes without departing from the spirit and scope of the present invention.

As described above in detail, according to the apparatus of the present invention, either a lowland ISC learning value or a highland ISC learning value is selected appropriately in accordance with the atmospheric pressure value as an ISC learning value for use in computing a feedback correction quantity. Accordingly, even if a state occurs in which atmospheric pressure learning is not performed at the time when a vehicle descends a slope, for example, the ISC learning value is switched to a lowland ISC learning value, which has been stored before ascending a slope, as soon as the atmospheric pressure value returns to a normal value, and the lowland ISC learning value is used to obtain a final ISC output value. As a result, a drop in the ISC output value can be prevented, so that it is possible to prevent a reduction in the rotational speed or a stall of an internal combustion engine from occurring.

It is claimed:

1. A rotational speed control apparatus for internal combustion engines, comprising:

atmospheric pressure presumptive computation means for computing a presumed atmospheric pressure indirectly based on a predetermined control value and a detection value which vary with a change of a driving state of an internal combustion engine;

an idling speed control valve provided in a bypass to bypass a throttle valve of said internal combustion engine and capable of controlling an opening degree of said bypass;

a reference control quantity computing means for computing a reference control quantity of said idling speed control valve in accordance with said presumed atmospheric pressure;

feedback correction quantity computing means for computing a feedback correcting quantity for said reference control quantity as a function of a detected rotational speed to control said detected rotational speed at a desired rotational speed which is set in accordance with a temperature of said internal combustion engine;

idling speed control learning value storage means for sequentially updating and storing said feedback correcting quantity as an idling speed control learning value, when said feedback correcting quantity has been stabilized within a predetermined range, said idling speed control learning value storage means including a lowland learning value storage section for storing said idling speed control learning value obtained in said lowland corresponding area as a lowland idling speed control learning value and a highland learning value storage section for storing said idling speed control learning value obtained in said highland corresponding area as a highland idling speed control learning value;

idling speed control valve drive control means for driving said idling speed control valve based on said reference control quantity, said feedback correcting quantity and said idling speed control learning value; means, high/low pressure area determining means for discriminating between a lowland corresponding area and a highland corresponding area depending on whether or not said presumed atmospheric pressure is equal to or higher than a predetermined atmospheric pressure corresponding to a highland; and idling speed control learning value selection means for selecting said lowland idling speed control learning value when a result of said discrimination by said high/low pressure area determining means indicates said lowland corresponding area, and for selecting said highland idling speed control learning value when said result of said discrimination by said high/low pressure area determining means indicates said highland corresponding area, respectively, as an idling speed control learning value for use in a next feedback correcting quantity computation by said feedback correction quantity computing means.

2. A rotational speed control apparatus for internal combustion engines according to claim 1, further comprising:

atmospheric pressure erroneous presumptive determination means for determining that said presumed atmospheric pressure is erroneous, when said throttle opening degree of said internal combustion engine is equal to or smaller than a predetermined value, said engine rotational speed is equal to or higher than a predetermined value, and said presumed atmospheric pressure falls within said highland corresponding area; and atmospheric pressure substitution means for substituting a predetermined atmospheric pressure value corresponding to said lowland corresponding area for said erroneously presumed atmospheric pressure, when said atmospheric pressure erroneous presumptive determination means determines that said presumed atmospheric pressure is erroneous.

3. A rotational speed control apparatus for internal combustion engines according to claim 1, wherein said atmospheric pressure presumptive computation means includes means for detecting an atmospheric pressure based on an intake air quantity of said internal combustion engine when said throttle opening degree is equal to or larger than a predetermined value.

4. A rotational speed control apparatus for internal combustion engines according to claim 1, wherein said atmospheric pressure presumptive computation means includes means for detecting an atmospheric pressure based on an intake pipe air pressure of said internal combustion engine when said throttle opening degree is equal to or larger than a predetermined value.

5. A rotational speed control apparatus for internal combustion engines according to claim 1, further comprising means for replacing said highland idling speed control learning value stored in said highland learning value storage section by said lowland idling speed control learning value stored in said lowland learning value storage section when a result of said discrimination by said high/low pressure area determinating means indicates said lowland corresponding area.

6. A rotational speed control apparatus for internal combustion engines according to claim 1, further comprising:

means for updating and storing said idling speed control learning value as said highland idling speed control learning value in said highland learning value storage section; and means for updating and storing said idling speed control learning value as said lowland idling speed control learning value in said lowland learning value storage section only when a result of said discrimination by said high/low pressure area determinating means indicates said lowland corresponding area.

7. A rotational speed control apparatus for internal combustion engines, comprising:

atmospheric pressure detecting means for detecting an atmospheric pressure;

an idling speed control valve provided in a bypass to bypass a throttle valve of an internal combustion engine and capable of controlling an opening degree of said bypass;

reference control quantity computing means for computing a reference control quantity of said idling speed control valve in accordance with said atmospheric pressure;

feedback correction quantity computing means for computing a feedback correcting quantity for said reference control quantity as a function of a detected rotational speed to control said detected rotational speed at a desired rotational speed which is set in accordance with a temperature of said internal combustion engine;

idling speed control learning value storage means for sequentially updating and storing said feedback correcting quantity as an idling speed control learning value, when said feedback correcting quantity has been stabilized within a predetermined range, said idling speed control learning value storage means including a lowland learning value storage section for storing said idling speed control learning value obtained in said lowland corresponding area as a lowland idling speed control learning value and a highland learning value storage section for storing said idling speed control learning value obtained in said highland corresponding area as a highland idling speed control learning value;

idling speed control valve drive control means for driving said idling speed control valve based on said reference control quantity, said feedback correcting quantity, and said idling speed control learning value;

high/low pressure area determining means for discriminating between a lowland corresponding area and a highland corresponding area depending on whether or not said detected atmospheric pressure is equal to or higher than a predetermined atmospheric pressure corresponding to a highland;

idling speed control learning value selection means for selecting said lowland idling speed control learning value when a result of said discrimination by said high/low pressure area determining means indicates said lowland corresponding area, and for selecting said highland idling speed control learning value when said result of said discrimination by said high/low pressure area determining means indicates said highland corresponding area, respectively, as an idling speed control learning value for use in a next feedback correcting quantity computation by said feedback correction quantity computing means;

atmospheric pressure erroneous detection determination means for determining that said detected atmospheric pressure is erroneous, when said throttle opening degree of said internal combustion engine is equal to or smaller than a predetermined value, said engine rotational speed is equal to or higher than a predetermined value, and said detected atmospheric pressure falls within said highland corresponding area; and atmospheric pressure substitution means for substituting a predetermined atmospheric pressure value corresponding to said lowland corresponding area for said erroneously detected atmospheric pressure, when said atmospheric pressure erroneous detection determination means determines that said detected atmospheric pressure is erroneous.

8. A rotational speed control apparatus for internal combustion engines, comprising:

atmospheric pressure detecting means for detecting an atmospheric pressure;

an idling speed control valve provided in a bypass to bypass a throttle valve of an internal combustion engine and capable of controlling an opening degree of said bypass;

reference control quantity computing means for computing a reference control quantity of said idling speed control valve in accordance with said atmospheric pressure;

feedback correction quantity computing means for computing a feedback correcting quantity for said reference control quantity as a function of a detected rotational speed to control said detected rotational speed at a desired rotational speed which is set in accordance with a temperature of said internal combustion engine;

idling speed control learning value storage means for sequentially updating and storing said feedback correcting quantity as an idling speed control learning value, when said feedback correcting quantity has been stabilized within a predetermined range, said idling speed control learning value storage means including a lowland learning value storage section for storing said idling speed control learning value obtained in said lowland corresponding area as a lowland idling speed control learning value and a highland learning value storage section for storing said idling speed control learning value obtained in said highland corresponding area as a highland idling speed control learning value;

idling speed control valve drive control means for driving said idling speed control valve based on said reference control quantity, said feedback correcting quantity, and said idling speed control learning value;

high/low pressure area determining means for discriminating between a lowland corresponding area and a highland corresponding area depending on whether or not said detected atmospheric pressure is equal to or higher than a predetermined atmospheric pressure corresponding to a highland;

idling speed control learning value selection means for selecting said lowland idling speed control learning value when a result of said discrimination by said high/low pressure area determining means indicates said lowland corresponding area, and for selecting said highland idling speed control learning value when said result of said discrimination by said high/low pressure area determining means indicates said highland corresponding area, respectively, as an idling speed control learning value for use in a next feedback correcting quantity computation by said feedback correction quantity computing means;

atmospheric pressure erroneous detection determination means for determining that said detected atmospheric pressure is erroneous, when said throttle opening degree of said internal combustion engine is equal to or smaller than a predetermined value, said engine rotational speed is equal to or higher than a predetermined value, and said detected atmospheric pressure falls within said highland corresponding area; and atmospheric pressure substitution means for substituting a predetermined atmospheric pressure value corresponding to said lowland corresponding area for said erroneously detected atmospheric pressure, when said atmospheric pressure erroneous detection determination means determines that said detected atmospheric pressure is erroneous.

* * * * *